United States Patent [19]

Hougard

[11] Patent Number: 4,658,540

[45] Date of Patent: Apr. 21, 1987

[54] HANGING PLANT POT, ESPECIALLY FOR FLOWERS

[75] Inventor: Erling Hougard, Jyllinge, Denmark

[73] Assignee: OS Plastic A/S, Farum, Denmark

[21] Appl. No.: 767,585

[22] PCT Filed: Dec. 9, 1983

[86] PCT No.: PCT/DK83/00120

§ 371 Date: Jul. 26, 1985

§ 102(e) Date: Jul. 26, 1985

[87] PCT Pub. No.: WO85/02525

PCT Pub. Date: Jun. 20, 1985

[51] Int. Cl.[4] ..... A01G 9/02

[52] U.S. Cl. ..... 47/67; 47/66

[58] Field of Search ..... 47/66, 67; 248/318; 411/508; 24/453, 207

[56] References Cited

U.S. PATENT DOCUMENTS 3,943,661 3/1976 DeVito et al. ..... 47/67

3,981,099 9/1976 Dziewulski ..... 47/67

4,138,803 2/1979 Sherlock ..... 47/67

*Primary Examiner*—Robert A. Hafer

*Assistant Examiner*—Bradley M. Lewis

*Attorney, Agent, or Firm*—Pennie & Edmonds

[57] ABSTRACT

A hanging plant pot particularly for flowers, consists of a vessel which at the top has an encircling edge flange provided with anchoring openings for a releasable hooking of the vessel on suspension means e.g. bars, chains or straps. The openings have an oblong shape with a maximum dimension essentially oriented radially in relation to the vessel axis. At that end which is defined to enter the openings, the suspension means have a shaft part, the free end of which is provided with a pair of shoulders extending laterally in opposite directions from said shaft and which measured transversely to the shaft, have a total extension which is larger than the smallest one of the opening but at the utmost as large as the largest internal cross-section of the opening.

3 Claims, 3 Drawing Figures

HANGING PLANT POT, ESPECIALLY FOR FLOWERS

Figure 1:
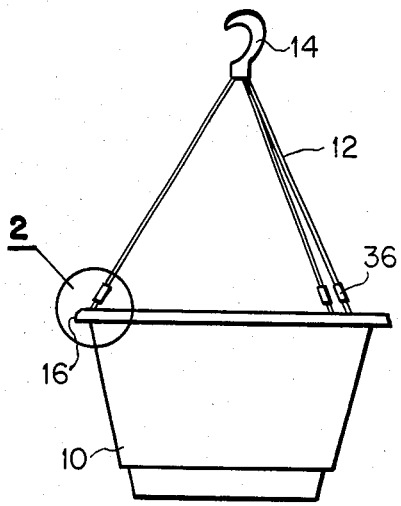

The present invention relates to a hanging plant pot, especially for flowers, consisting of a vessel having at the top thereof an encircling edge flange which is provided with anchoring openings for a releasable hooking of the vessel to suspension means, e.g. bars, chains or straps.

The suspension means are usually assembled at the upper end thereof, e.g. in a hook which again is placed on a stationary hook, e.g. in a ceiling. This means that the suspension means affect the vessel of the plant pot with an oblique suspension tension tending to load the edge flange around the anchoring openings to such a degree that it is distorted. This especially occurs in cases where the vessel is made of a flexible plastic material.

The object of the invention consists in stating how this disadvantage is avoided.

According to the invention this is obtained in that the openings have an oblong shape with the maximum dimension oriented substantially radially relative to the vessel axis, that at the end to be entered in the openings the suspension means comprise a shaft member, the free end of which is provided with a pair of shoulders projecting laterally in opposite directions from said shaft and, measured transversely to the shaft, having an extension which is larger than the smallest internal cross-section of the opening but at the utmost as large as the largest internal cross-section of the opening, that at a portion remote from the free end of the shaft and in continuation of the shoulders said shaft comprises abutment surfaces extending transversely to the shoulders, said abutment surfaces defining a transverse measurement of the portion substantially corresponding to the smallest internal cross-section of the opening, that remoter from the free end of the shaft said shaft comprises a portion having a cross-sectional area which does not exceed the smallest internal cross-section of the opening, and that along the long sides of the opening at the bottom of the flange, guide surfaces are provided which are adapted to co-operate with the shoulders and extending upwards obliquely towards the central axis of the vessel.

When the suspension means are to be placed, the shaft portion having the shoulders oriented in the longitudinal direction of the opening is introduced through the opening until the portion of the shaft situated remotest from the free end of said shaft is in the opening. In consequence of the diameter of this portion it will then be possible to rotate the shaft portion in the opening so that the shoulders extend transversely to the length of the anchoring openings. The suspension means thereafter are somewhat withdrawn, i.e. drawn upwards, this resulting in the shoulder being carried upward towards the opening so that the shoulder surfaces are allowed to abut against the edge portions of the flange defining the long sides of the anchoring opening. At the same time, the abutment surfaces of the shaft portion situated nearest to the shoulders are entered in the opening where, in consequence of the above mentioned dimensions, the shaft is then retained against rotation. During said drawing upward the shoulders are moreover guided by said guiding surfaces in the direction towards the inner edge of the edge flange where the flange terminates in the side wall of the vessel, so that a considerable portion of the appearing tension will be transferred to the area around the upper end of the side wall, thereby permitting the flange to be relieved from bending forces.

According to the invention the guiding surfaces may be formed by ribs extending along the long side edges of the opening. The ribs are then allowed to contribute to retaining the shaft portion against rotation and at the same time, since they are extending in the width of the flange, the ribs co-operate to stiffen the flange in the area of suspension.

The invention will be further described in the following with reference to the drawing, in which FIG. 1 is a schematic view of a hanging plant pot according to the invention in suspended position, FIG. 2 an enlarged view of a cross-section along the line II—II in FIG. 1 through a portion of the edge flange of the vessel of the plant pot with a suspension member inserted in an anchoring opening, and FIG. 3 a sectional view of the same along the line III—III in FIG. 2.

A plant pot vessel 10, e.g. for flowers, is connected by means of three suspension members 12 in the form of thin bars to a hook 14 adapted to be suspended, e.g. in a ceiling. In consequence of the assembling of the upper ends of the bars at the hook, the bars 12 are occupying an oblique position, which results in an obliquely upward, inwardly directed tension being exerted on the edge flange 16 of the vessel 10 when the plant pot is suspended, the bars 12 being provided at the bottom thereof with connecting means adapted to be releasably hooked in anchoring openings 18 formed in the flange 16, vide FIGS. 2 and 3.

Figure 2:
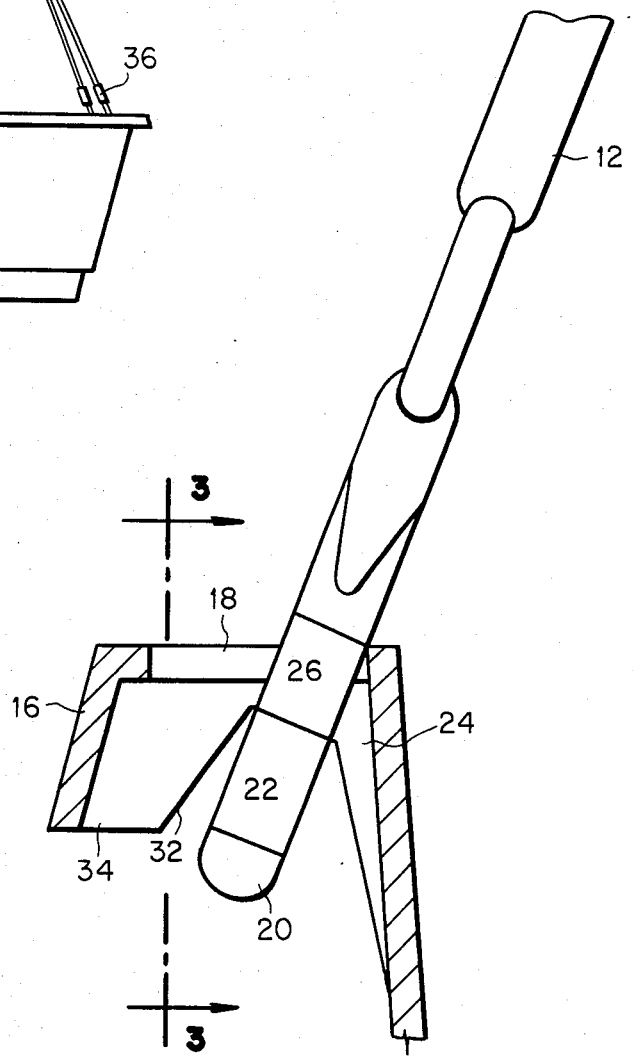
Figure 3:
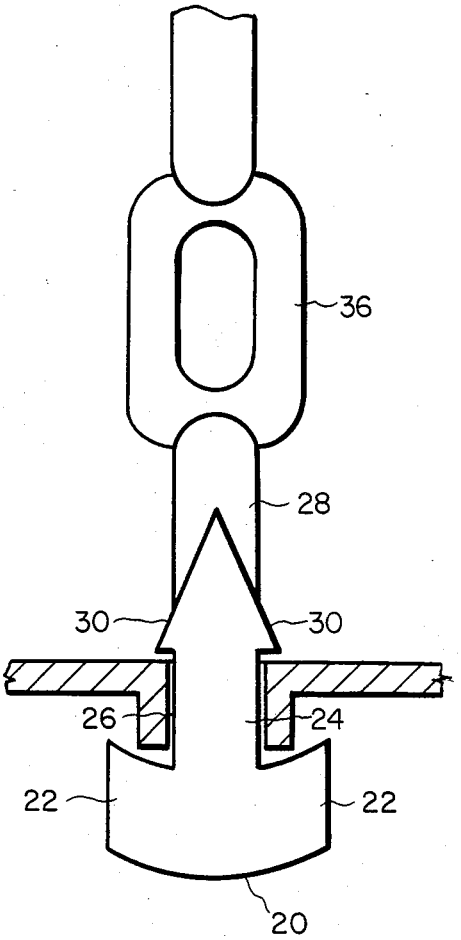

As will appear from a comparison between FIGS. 2 and 3, the anchoring openings 18 have an oblong shape with the maximum dimension oriented substantially radially relative to the central axis of the vessel 10. The lower end of each bar 12 is adapted to be entered in an opening 18 of its own and comprises at the extremity thereof a shaft portion 20, the free end of which is provided with a pair of shoulders 22 projecting laterally in opposite directions and, measured transversely to the shaft, having a total extension which is larger than the smallest internal cross-section of the opening 18 but at the utmost as large as the largest internal cross-section of the opening, cf. FIGS. 3 and 2. This shaft portion is followed by another shaft portion 24, which comprises abutment surfaces 26 extending transversely to the shoulders 22 and defining a transverse measurement of the shaft substantially corresponding to the smallest internal cross-section of the opening 18, vide FIG. 3. Again, said shaft portion is followed by a shaft portion 28, the sectional area of which does not exceed the smallest internal cross-section of the opening 18. Between the shaft portion 24 and the shaft portion 28 the shaft is provided with barring shoulders 30 projecting laterally in the same plane as the shoulders 22, the total lateral extension of said shoulders 30 being larger than the smallest internal cross-section of the opening 18. At the bottom of the flange 16 guide surfaces 32 are placed along the long sides of the opening 18, which are adapted to co-operate with the shoulders and are extending upwards obliquely towards the central axis of the vessel 10 of the plant pot. In the shown embodiment these surfaces are provided by ribs 34.

The suspension means 12 are anchored to the flange 16 in that the shaft portion 20 having the shoulders 22 oriented in the longitudinal direction of the opening 18 is entered so far through the opening that the shaft portion 28 occupies a position within the opening 18. The shaft is thereafter rotated 90° so that the shoulders will occupy the relative position shown in FIG. 3, in which at the bottom they are facing the ribs 34. By an oblique, upwardly directed tension the shoulders 22 are carried upwards obliquely towards the termination of the flange 16 in the upper end of the side wall of the vessel 10, vide FIG. 2. The shaft portion 24 at the same time is brought into an unrotatable position of engagement with the opening 18 and between the ribs 34, and in this position the suspension means 12 are secured by means of the barring shoulders 30 which will then engage the upper edge surface of the opening 18, vide FIG. 3.

36 is a handle for rotating the shaft portions.

I claim:

1. A hanging plant pot and suspension means therefore, especially for flowers, said pot consisting of a vessel (10) having at the top thereof an encircling edge flange (16) which is provided with anchoring openings (18) for a releasable hooking of the vessel (10) on said suspension means (12) characterized in that the openings (18) have an oblong shape with the maximum dimension oriented substantially radially relative to the vessel axis, that at the end to be entered in the openings (18) the suspension means (12) comprise a shaft member (20), the free end of which is provided with a pair of shoulders (22) projecting laterally in opposite directions from said shaft and, measured transversely to the shaft, having a total extension which is larger than the smallest internal cross-section of the opening (18) but at the utmost as large as the largest internal cross-section of the opening (18), that at a portion (24) remote from the free end of the shaft and in continuation of the shoulders (22) said shaft comprises abutment surfaces (26) extending transversely to the shoulders (22), said abutment surfaces defining a transverse measurement of the portion substantially corresponding to the smallest internal cross-section of the opening (18) and engaging with said opening (18) to thereby prevent rotation of said shaft within opening (18), that more remote from the free end of the shaft said shaft comprises a portion (28) having a cross-sectional area which does not exceed the smallest internal cross-section of the opening (18), and that along the long sides of the opening (18) at the bottom of the flange (16), guide surfaces (32) are provided which are adapted to co-operate with the shoulders (22) and extend upwards obliquely towards the central axis of the vessel (10).

2. A hanging plant pot according to claim 1, characterized in that the guide surfaces (32) are formed by ribs (34) extending along the long side edges of the opening (18) to engage the top of the shoulders (22).

3. A hanging plant pot according to claim 1 or 2, characterized by laterally projecting, displacement-impeding barring shoulders (30) being provided at the shaft between the abutment surfaces (24) and the more remote portion (28).

* * * * *